US006840010B2

(12) United States Patent
Chen et al.

(10) Patent No.: US 6,840,010 B2
(45) Date of Patent: Jan. 11, 2005

(54) TROLLEY MEMBER OF GARAGE DOOR OPENER SYSTEM

(75) Inventors: Shaodong Chen, Suzhou (CN); Zhao Kong, Suzhou (CN)

(73) Assignee: Positec Power Tools (Suzhou) Co., Ltd., Suzhou (CN)

( * ) Notice: Subject to any disclaimer, the term of this patent is extended or adjusted under 35 U.S.C. 154(b) by 0 days.

(21) Appl. No.: 10/616,503

(22) Filed: Jul. 9, 2003

(65) Prior Publication Data

US 2004/0055219 A1 Mar. 25, 2004

(30) Foreign Application Priority Data

Jul. 26, 2002 (CN) ..... 02263408 U

(51) Int. Cl.[7] ..... E05F 15/00
(52) U.S. Cl. ..... 49/139; 192/82 P
(58) Field of Search ..... 49/139, 197, 199; 74/625; 192/71, 82 P

(56) References Cited

U.S. PATENT DOCUMENTS 4,628,636 A * 12/1986 Folger ..... 49/199
5,253,451 A * 10/1993 Hormann ..... 49/139

* cited by examiner

*Primary Examiner*—Jerry Redman
(74) *Attorney, Agent, or Firm*—Hedman & Costigan, P.C.

(57) ABSTRACT

A trolley member for a garage door opener, comprises a trolley body (2), a connecting rod (7), a gear shaft (3) disposed on the trolley body (2), a rack (5) disposed on the trolley body (2), a gear (9) disposed on the gear shaft (3). The teeth of the gear (9) is engaged with the teeth of the rack (5). The rack (5) is connected to a spring device. The rack (5) has two working status. A first working status is that the rack (5) is inserted into a slot (10) of a chain link (8) and the spring member urges the rack (5) to the first working status, and a second working status is that the rack (5) is detached from the slot (10). The rack (5) is always urged to the first working status by the spring device, thereby the motor can reliably drive the chain and then the trolley member moving, and the chain can not be idling.

4 Claims, 4 Drawing Sheets

TROLLEY MEMBER OF GARAGE DOOR OPENER SYSTEM

FIELD OF THE INVENTION

The present utility relates to a trolley member of a garage door opener.

BACKGROUND OF THE INVENTION

In the existing technology, the rail of the garage door opener arranges a trolley member which is connected to the garage door by a connecting rod. In normal condition, the trolley is connected to the chain, and the motor drives the chain moving, thus, the chain drives the trolley member moving in the rail which causes the garage door opening or closing. In the urgency condition (such as the motor is broken), the garage door is moved by manual, and at the same time, the trolley member is needed to detach from the chain, thus, the manual causes the garage door moving. The existing trolley member has two steady working status, so once the motor is changed from power off to power on, the trolley member may still be detached from the chain, thereby the motor can drive the idling chain, and the chain can not be driven to move the trolley and then the garage door.

SUMMARY OF THE INVENTION

The object of the present utility is to provide a trolley member of the garage door opener which is used reliably.

The technology project of the present utility is: A trolley member for a garage door opener comprising a trolley body, a connecting rod connected to the trolley body, the trolley member further comprising a gear shaft disposed on the trolley body and rotatably connected to the trolley body, a rack disposed on the trolley body and rotatably connected to the trolley body, a gear disposed on the gear shaft, teeth of the gear engaged with the teeth of the rack, the rack connected to the a spring device, the rack having two working status wherein a first working status is that the rack is inserted into a slot of a chain link and the spring member urging the rack to the first working status, and a second working status is that the rack is detached from the slot.

The present utility has advantages below with respect to the existing arts.

The rack is always urged to the first working status by the spring device, unless the gear is operated by manual to cause the rack is in the second working status. When the force applied to the gear is released, the rack is automatically changed from the second working status to the first working status, therefore the motor reliably drives the chain and then the trolley member moving, and the chain can not be idling.

BRIEF DESCRIPTION OF THE DRAWINGS

FIG. 4 is a cross-section view taken along B-B direction of FIG. 1; wherein:

(1) pulling handle; (2) trolley body; (3) gear shaft;

(4) torsion spring; (5) rack; (7) connecting rod; (8) chain link (9) gear; (10) slot; (11) torsion spring shaft.

DETAILED DESCRIPTION OF THE EMBODIMENT

Figure 1:
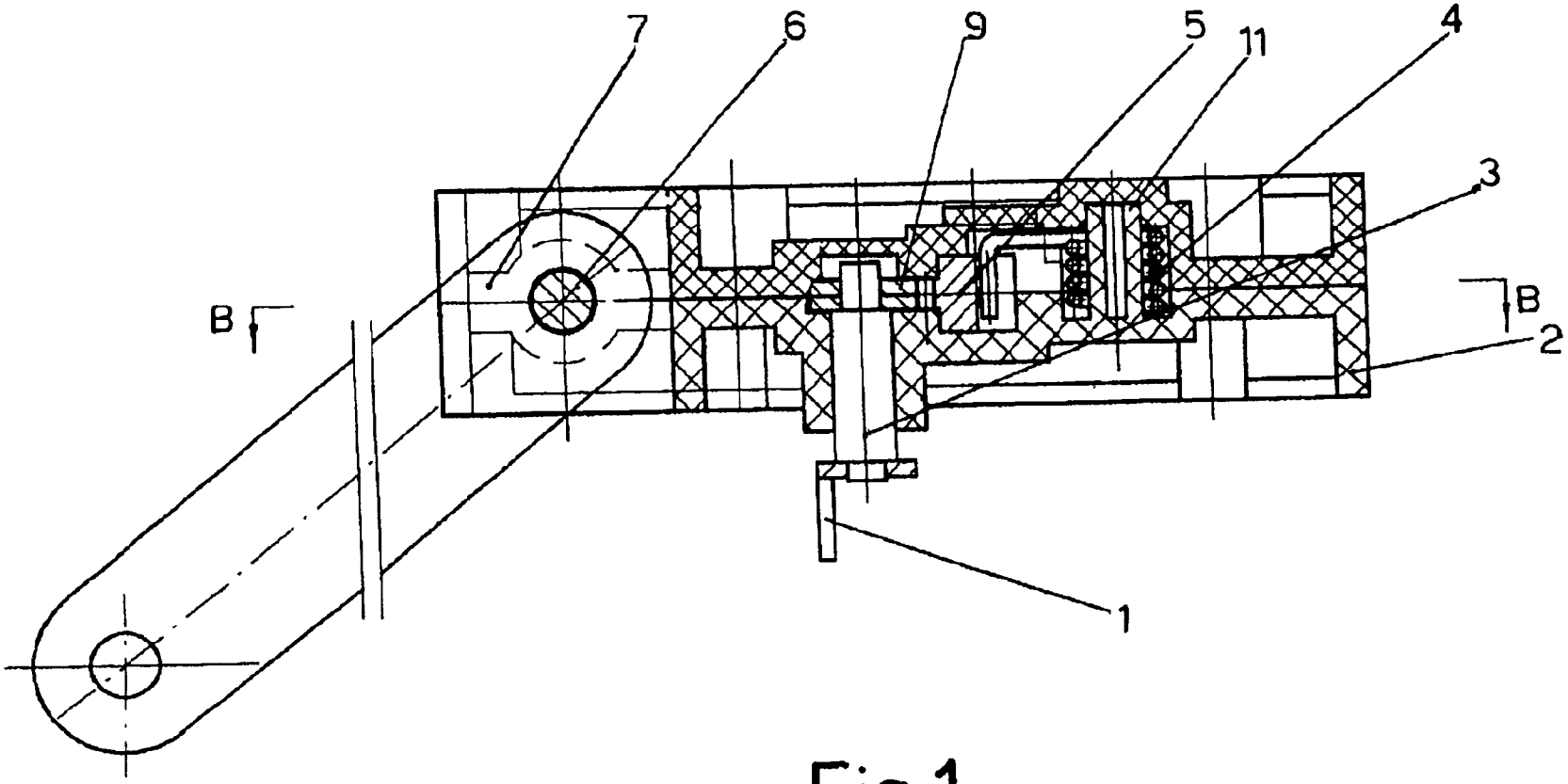
FIG. 1 is a front view of the present utility (cross-section view taken along A— A direction of FIG. 2)
Figure 2:
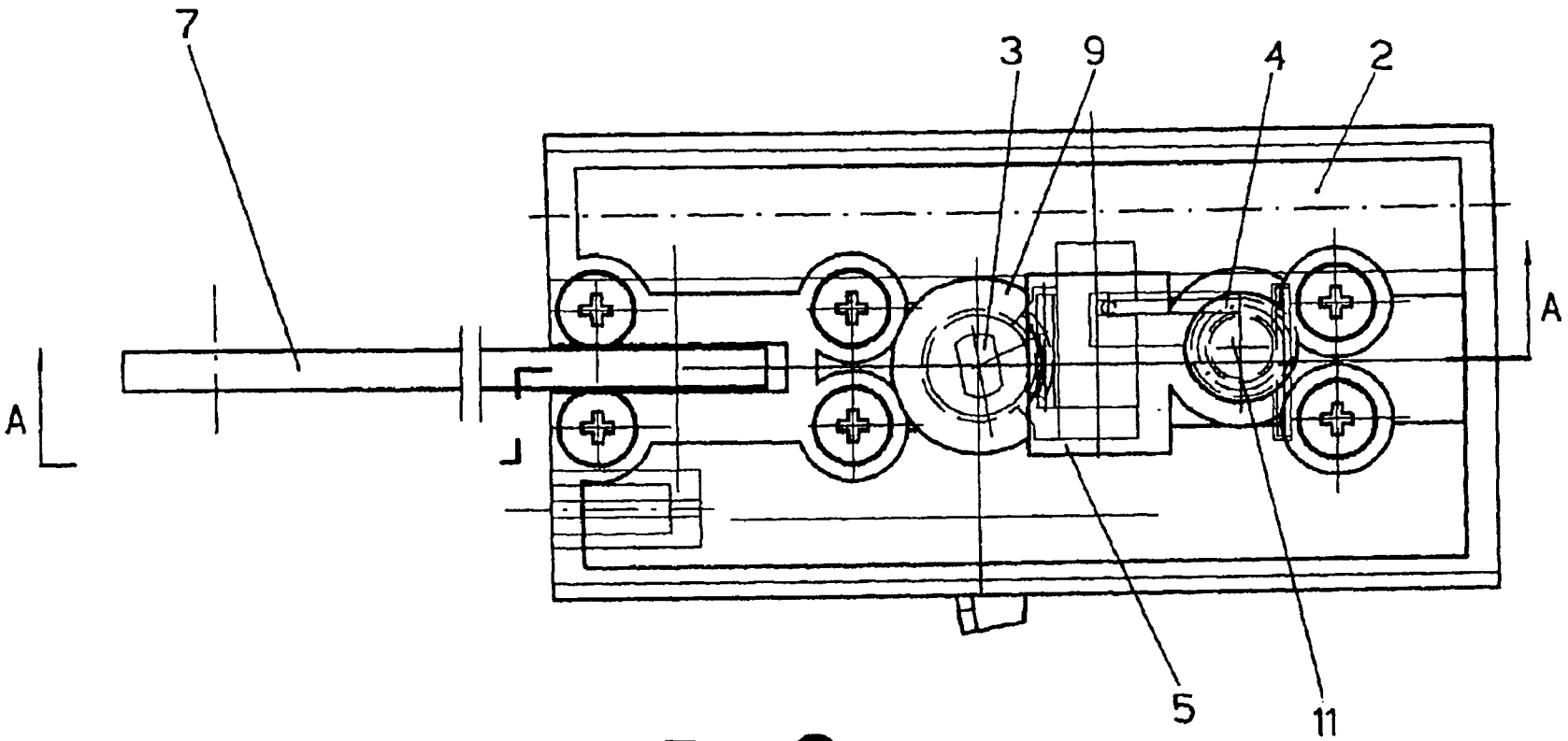
FIG. 2 is a top view of FIG. 1.
Figure 3:
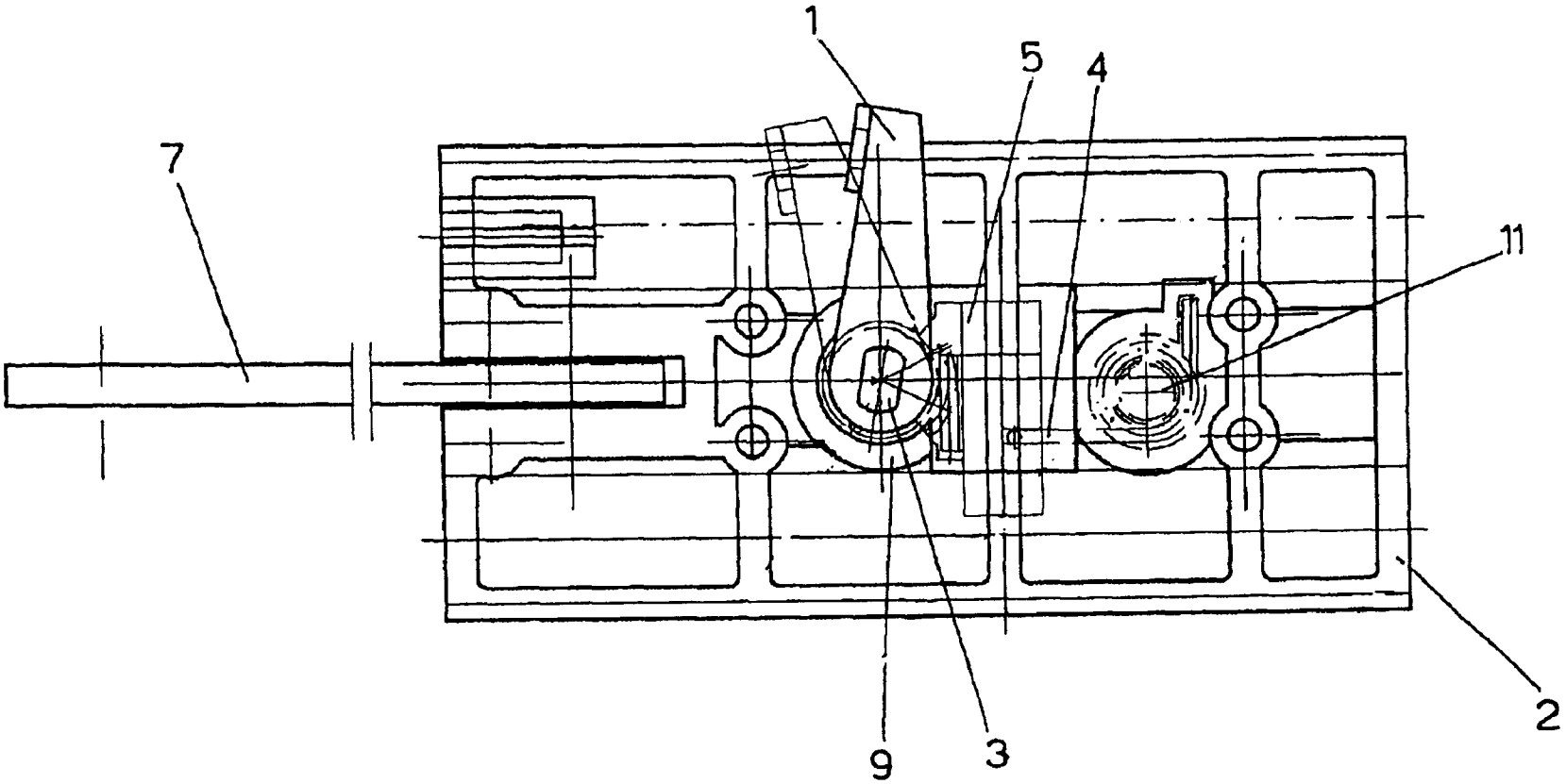
FIG. 3 is a bottom view of FIG. 1.
Figure 4:
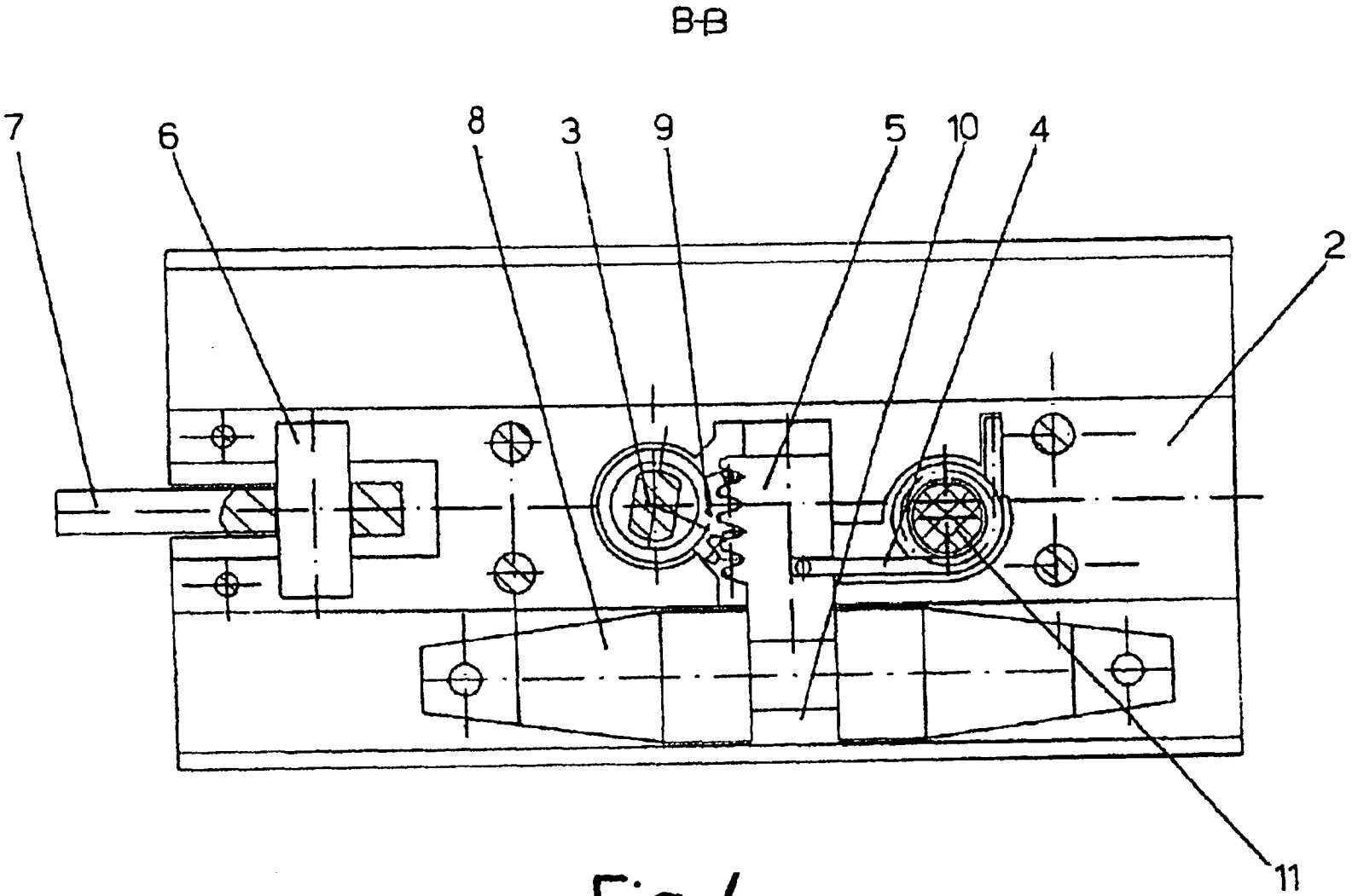

Referring to FIGS. 1 to 4, a trolley member for a garage door opener, comprises a trolley body (2), a connecting rod (7) rotatably connected to the trolley body (2). The trolley member further comprises a gear shaft (3) disposed on the trolley body (2) and rotatably connected to the trolley body (2). A rack (5) is disposed on the trolley body (2) and rotatably connected thereto. A gear (9) is disposed on the gear shaft (3). The gear shaft (3) includes a pulling handle (1) radiusly extended. When the rack (5) is changed from a first working status to the second working status, the tangent direction of the movement of the pulling handle (1) is substantively parallel to the moving direction of the trolley body (2). As shown in FIG. 3, the teeth of the gear (9) is engaged with the teeth of the rack (5). The rack (5) is connected to the spring device, and has two working status. A first working status of the rack (5) is that the rack (5) is inserted into a slot (10) of a chain link (8) and the spring member urges the rack (5) to the first working status, and at the same time, the motor drives the chain moving, the chain link (8) drives the rack (5), the rack (5) drives the trolley body (2) moving in the rail, and the connecting rod (7) of the trolley body (2) drives the garage door moving. A second working status is an urgent working status of the motor with power off, and the gear shaft (3) needs to be rotated on the pulling handle (1) which causes the teeth of the gear (3) driving the rack (5) moving; thus, one end of the rack is detached from the slot (10).

The spring member is a torsion spring (4), one end of the torsion spring is connected to the trolley body (2), and the other end of the torsion spring is connected to the rack (5). The trolley body (2) includes a torsion spring shaft (11), and the torsion spring (4) is enclosed on the torsion spring shaft (11).

What is claimed is:

1. A trolley member for a garage door opener, comprising a trolley body (2), a connecting rod (7) connected to the trolley body, the trolley member further comprising a gear shaft (3) disposed on the trolley body (2) and rotatably connected to the trolley body (2), a rack (5) disposed on the trolley body (2) and rotatably connected to the trolley body (2), a gear (9) disposed on the gear shaft (3), teeth of the gear (9) engaged with teeth of the rack (5), the rack (5) connected to the a spring device, the rack (5) having two working status wherein a first working status is that the rack (5) is inserted into a slot (10) of a chain link (8) and the spring member urging the rack (5) to the first working status, and a second working status is that the rack (5) is detached from the slot (10).

2. The trolley member according to claim 1, further comprising the spring member is a torsion spring (4), one end of the torsion spring is connected to the trolley body (2), the other end of the torsion spring is connected to the rack (5).

3. The trolley member according to claim 1, further comprising the trolley body (2) includes a spring member shaft (11), and the torsion spring (4) is enclosed on the torsion spring shaft (11).

4. The trolley member according to claim 1, further comprising the gear shaft (3) comprises a pulling handle (1) radiusly extended, the tangent direction of the movement of the pulling handle (1) is substantively parallel to the moving direction of the trolley body (2).

* * * * *